US005587971A

United States Patent [19]

Thinesen

[11] Patent Number: 5,587,971

[45] Date of Patent: Dec. 24, 1996

[54] MODE PRESELECT FUNCTION FOR A MULTIMODE ELECTRONIC TIMEPIECE

[75] Inventor: Tom Thinesen, Sunnyvale, Calif.

[73] Assignee: Timex Corporation, Middlebury, Conn.

[21] Appl. No.: 603,972

[22] Filed: Feb. 20, 1996

[51] Int. Cl.[6] ..... G04B 19/30; G04C 19/00

[52] U.S. Cl. ..... 368/70; 368/82; 368/187

[58] Field of Search ..... 368/69–70, 73, 368/74, 185–188, 82–84

[56] References Cited

U.S. PATENT DOCUMENTS

| | | | |
|---|---|---|---|
| 4,780,864 | 10/1988 | Houlihan | 368/10 |
| 4,783,773 | 11/1988 | Houlihan et al. | 368/108 |
| 4,989,188 | 1/1991 | Thinesen | 368/70 |
| 5,008,866 | 4/1991 | Thinesen | 368/21 |
| 5,140,563 | 8/1992 | Thinesen | 368/70 |
| 5,226,022 | 7/1993 | Thinesen | 368/22 |
| 5,257,245 | 10/1993 | Thinesen | 368/70 |

*Primary Examiner*—Vit W. Miska
*Attorney, Agent, or Firm*—William C. Crutcher

[57] ABSTRACT

A multimode electronic timepiece includes a display, a number of manually actuated switches, and an integrated circuit programmed to keep time, to provide a plurality of operating modes, including time-of-day, in a continuous loop, and to permit an operator of the timepiece to cycle through the operating modes sequentially by selectively and repetitively actuating a first of the switches. The improvement includes at least one preselect function mode which displays information from a preselected operating mode along with information from another operating mode. The preselect function mode(s) is engaged by selective actuation of a second of the switches, and in the preferred embodiment, this switch is also used to cycle through the preselect function modes sequentially (where there is more than one preselect function mode). Upon actuation of another switch, the timepiece shifts between a preselect function mode and the operating mode, other than the preselected operating mode, having its information displayed by the preselect function mode.

8 Claims, 4 Drawing Sheets

MODE PRESELECT FUNCTION FOR A MULTIMODE ELECTRONIC TIMEPIECE

This invention relates generally to multimode electronic timepieces. More specifically, the invention relates to an improved multimode electronic timepiece which permits viewing of information contained in a preselected operating mode while any one of the other operating modes is being engaged by a user, without the need for the user to cycle through a predetermined sequence of operating modes.

BACKGROUND OF THE INVENTION

Multimode, multifunction wristwatches (or wrist instruments) having a display, a lamp for illuminating the display, manually actuatable switches and an integrated circuit are well-known. Examples of such wristwatches include U.S. Pat. Nos. 4,783,773 (Houlihan et al.), 4,780,864 (Houlihan) and 4,283,784 (Horan), all of which are assigned to the assignee of the present invention. In the foregoing patents, which are merely exemplary of multimode electronic wrist instruments, one of the manually actuatable switches serves to repetitively cycle the wrist instrument through the various operating modes or states in a predetermined sequence, where each operating mode differs from the other operating modes by the type of information displayed. Such operating modes as time-of-day (TOD), chronograph (CHRONO), alternate time zone (T2), alarm setting (ALARM) and elapsed time (TIMER) are typically provided. While in any of these operating modes, another manually actuatable switch may be employed to change the information being displayed in that operating mode or state, such as initiating the chronograph timing or setting the alarm time.

As watches have come to incorporate more powerful integrated circuits, the number of operating modes provided by watches has proliferated. For example, today, it is not unusual for an electronic wrist instrument to provide, in addition to the operating modes listed above, a calculator (CALC) mode, a speedometer (SPEED) mode and a pulsometer (PULSE) mode. The problem with having so many operating modes is that since only one operating mode can be displayed at a time (due to limited display space), it is necessary to cycle through the predetermined sequence of operating modes to engage an operating mode other than the one in which the watch is then operating. To illustrate this, let's assume that a wrist instrument has the following predetermined sequence of operating modes: TOD - CHRONO - TIMER - ALARM - T2 - CALC - SPEED - PULSE. If the wrist instrument is in the TOD mode and a user desires to know the alternate time zone time, the user must cycle through CHRONO, TIMER and ALARM to obtain the information he/she seeks. As is apparent, cycling through the predetermined sequence each and every time information is desired from an operating mode other than the then engaged operating mode can be time consuming and frustrating to the user of the wrist instrument.

U.S. Pat. No. 4,989,188 (Thinesen), which is assigned to the assignee of the present invention, partially addresses the above problem. The '188 patent discloses a multimode electronic timepiece in which the user may directly "peek" at a second operating mode (which is preselected) from a specific first operating mode without cycling through the predetermined sequence of operating modes. The integrated circuit of the '188 parent's timepiece is programmed to display the preselected second operating mode upon actuation of a designated manually actuatable switch from the first operating mode. When the designated switch is released (so that the switch closure is no longer made), the timepiece reverts back to displaying the first operating mode. For example, let's assume that the preselected second operating mode is the T2 mode, the specific first operating mode is the TOD mode, the designated switch is S1, and the timepiece is currently in the TOD mode. If the user actuates S1, the timepiece will display the information in T2. When the user releases S1, the timepiece will go back to displaying TOD. Although the '188 parent's "peek" function overcomes the problem of having to cycle through unwanted operating modes to view, from a specific operating mode, the information contained in a preselected operating mode, it does not address the problem of having to cycle through unwanted operating modes to view, from any operating mode, the information contained in the preselected operating mode.

Why can't the '188 parent's "peek" function be applied so that it becomes possible to view, from any operating mode, the information contained in a preselected operating mode? The answer is very simple: design and cost constraints. To designate a specific switch to each operating mode for "peeking" purposes would be very difficult given the limited space available on a watch. For example, for a multimode electronic wristwatch having eight different operating modes, there would have to be seven manually actuatable switches to allow "peeking" from any operating mode (note that there is one less switch than the number of operating modes since no switch is needed for the preselected operating mode). As the number of available operating modes increases, there would have to be a likewise increase in the number of switches. Also, even assuming that a watch can be designed somehow to accommodate numerous switches, there would be an increase in manufacturing cost attributable to the incorporation of the various extra switches (not to mention the increased complexity of use and decreased aesthetic appeal caused by having numerous manually actuatable switches). Therefore, it is one object of the present invention to provide a multimode electronic wrist instrument which permits viewing, from any operating mode, the information contained in a preselected operating mode without the need to cycle through unwanted operating modes.

Another object of the invention is to provide a multimode electronic wrist instrument which permits viewing, from any operating mode, the information contained in a preselected operating mode with at most, a minimal increase in the number of components.

Still another object of the invention is to provide a multimode electronic wrist instrument which permits viewing, from any operating mode, the information contained in a preselected operating mode with, at most, a minimal increase in the complexity of use to the user.

SUMMARY OF THE INVENTION

Briefly stated, the invention is an improved multimode electronic timepiece of the type having a display, a plurality of manually actuated switches, and an integrated circuit programmed to keep time, to provide a set of at least three operating modes, including time-of-day, in a continuous loop, and to permit an operator of the timepiece to shift said operating modes sequentially by selectively and repetitively actuating a first of said switches. The improvement comprises mode preselect function means responsive to selective actuation of a second of said switches, said mode preselect function means comprising a program for the integrated circuit which provides a set of at least one preselect function mode in a continuous loop, each preselect function mode displaying information from a preselected operating mode along with information from another operating mode; said program being adapted to permit the operator of the timepiece to shift sequentially through the set of preselect function modes by selectively, and where there is more than one preselect function mode in the set, repetitively actuating a third of said switches; and said mode preselect function means being further responsive to selective actuation of a fourth of said switches, actuation of said fourth switch causing the timepiece to shift between a preselect function mode and the operating mode, other than the preselected operating mode, having its information displayed by said preselect function mode.

DRAWINGS

The subject matter which is regarded as the invention is particularly pointed out and distinctly claimed in the concluding portion of the specification. The invention, however, both as to organization and method of practice, together with further objects and advantages thereof, may best be understood by reference to the following description, taken in connection with the accompanying drawings, in which:

DESCRIPTION OF THE PREFERRED EMBODIMENT

Figure 1:
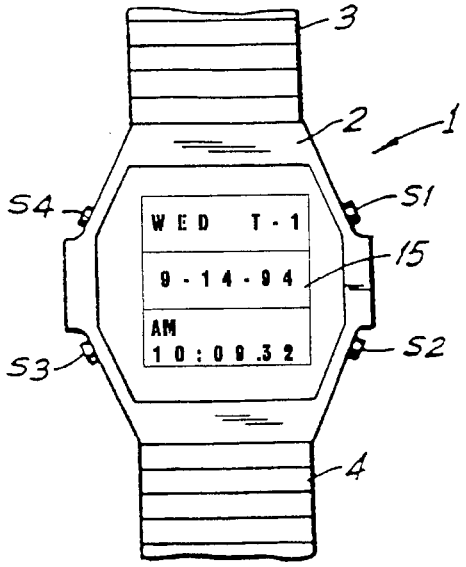
Fig. 1 Prior Art
FIG. 1 is a plan view of a typical multimode electronic timepiece in simplified form.

Referring now to FIG. 1 of the drawings, a typical multimode electronic timepiece 1 in the form of a wristwatch includes a case 2 adapted to be held on the wrist by a strap, portions of which are seen at 3 and 4. The case 2 has four manual push button actuators S1, S2, S3 and S4, also referred to as switches, arranged to close spring contacts (not shown) inside the timepiece case 2. An electro-optic display 15, which is commonly a liquid crystal display (LCD), exhibits digits, letters or other symbols when activated by a microcomputer inside the watch 1. The microcomputer is manifested in the form of an integrated circuit.

Figure 2:
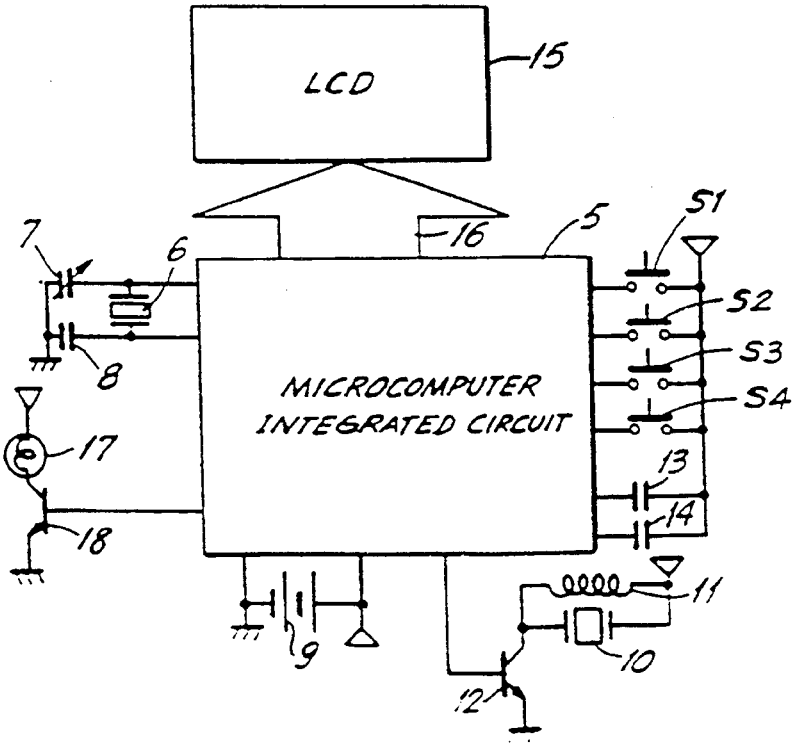
Fig. 2 Prior Art
FIG. 2 is a block diagram of a circuit for the timepiece of FIG. 1, together with external components such as lamp, switches and display.

FIG. 2 is a schematic block diagram of the electrical connections in accordance with conventional multimode electronic timepiece technology well known to those skilled in the art. A programmable microcomputer 5, in the form of a mask-programmable integrated circuit, is bonded to a printed circuit board (not shown), and includes suitable pin connections and leads connected to various external components shown in the diagram which are also mounted on the printed circuit board. The microcomputer 5 also includes a microprocessor, an operating system program for carrying out instructions, and memory locations.

A quartz crystal 6 coupled to capacitors 7 and 8 and connected to the oscillator pins of the integrated circuit 5 provides a high-frequency time base. A battery power source 9 is provided in the form of a button type energy cell in the watch case 2. A watch alarm is composed of a piezoelectric crystal 10, an inductance coil 11 and a drive transistor 12. Two fixed external capacitors 13 and 14, in conjunction with other circuit elements combined inside the integrated circuit 5, serve to boost the output voltage to drive the LCD 15 (also shown in FIG. 1) via a display bus 16, which represents several parallel leads connected to the various actuatable segments of the LCD 15. The LCD 15 is positioned in proximity to a lamp 17 so that when the lamp 17 is lit by a switching signal from the integrated circuit 5 applied to the base of a switching transistor 18, the LCD 15 will become illuminated.

Figure 3:
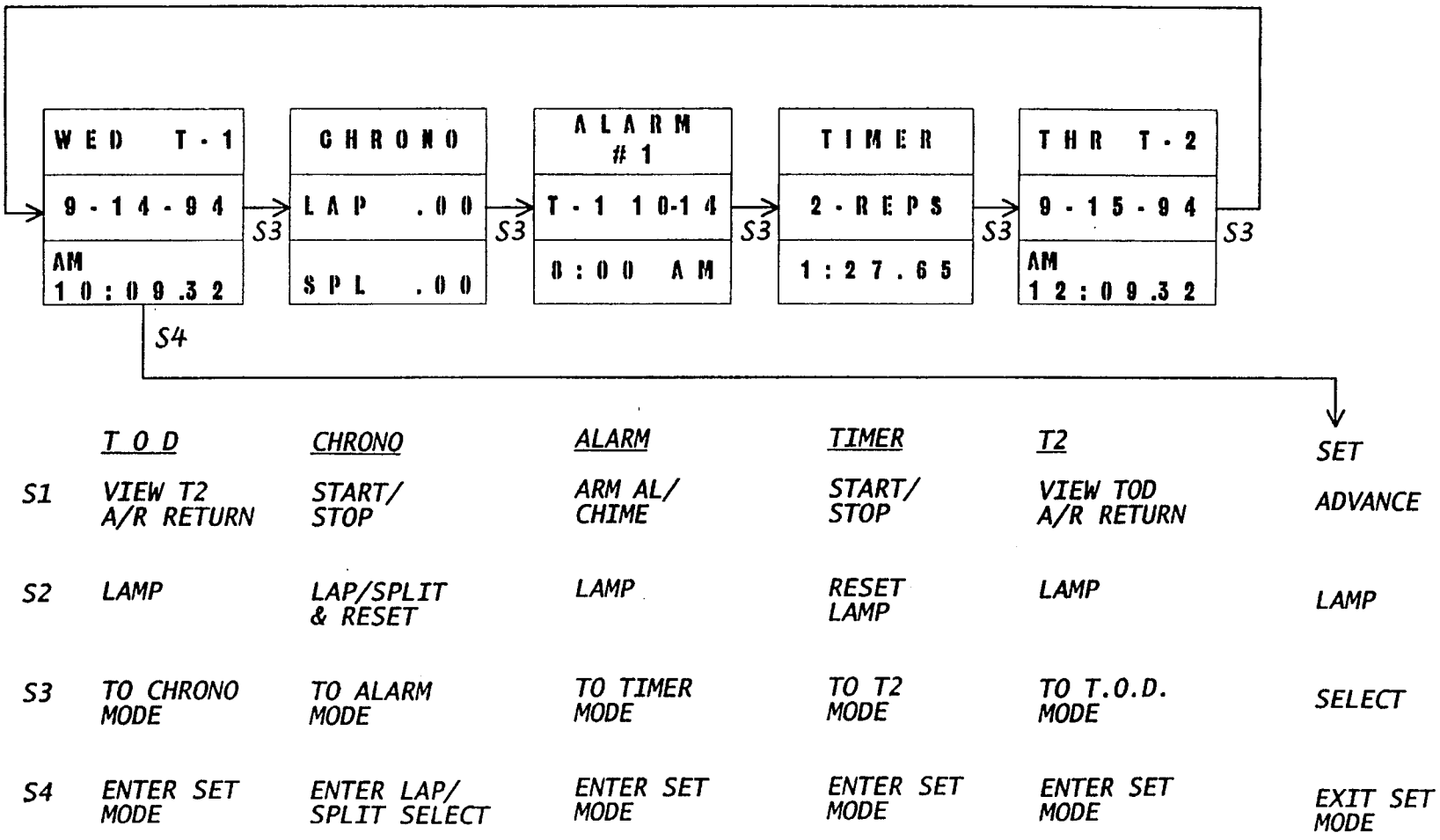
Fig. 3 Prior Art
FIG. 3 is a block diagram of the multimode timepiece of FIG. 1 illustrating the sequence of operating modes in response to manually actuated switches.

Referring now to FIG. 3, a block diagram of the typical multimode electronic wristwatch 1 illustrates the sequence of operating modes or states in response to manually actuating switches S1–S4 in accordance with the table. Each of the blocks illustrates the appearance of the display 15 at start-up for the operating modes shown. Beneath each of the display blocks is a column illustrating what happens when the respective switches S1–S4 are actuated while in that operating mode. The operating modes for this particular timepiece are TOD, CHRONO, ALARM, TIMER, and T2. Note that these operating modes are only representative of the various operating modes available for multimode electronic wristwatches. As indicated in the row opposite switch S3, the program is arranged to shift the operating modes sequentially in a continuous loop. Once in one of the five operating modes illustrated, actuation of switch S4 causes execution of a subroutine SET for changing the information displayed. Switch S3 will SELECT a particular piece of information which is indicated on the display by "flashing" the indicia for that piece of information, and switch S1 will ADVANCE the value of said piece of information. The operation illustrated in FIG. 3 is well known in the art.

In accordance with the present invention, the operating system program of the timepiece 1 is programmed to permit a user to view, from any operating mode, the information contained in a preselected operating mode without the user having to cycle through unwanted operating modes. This is accomplished by an alternate type of mode selection, referred to hereinafter as the mode preselect function. The operation of the timepiece 1 in mode preselect function will be described with reference to FIG. 4.

Figure 4:
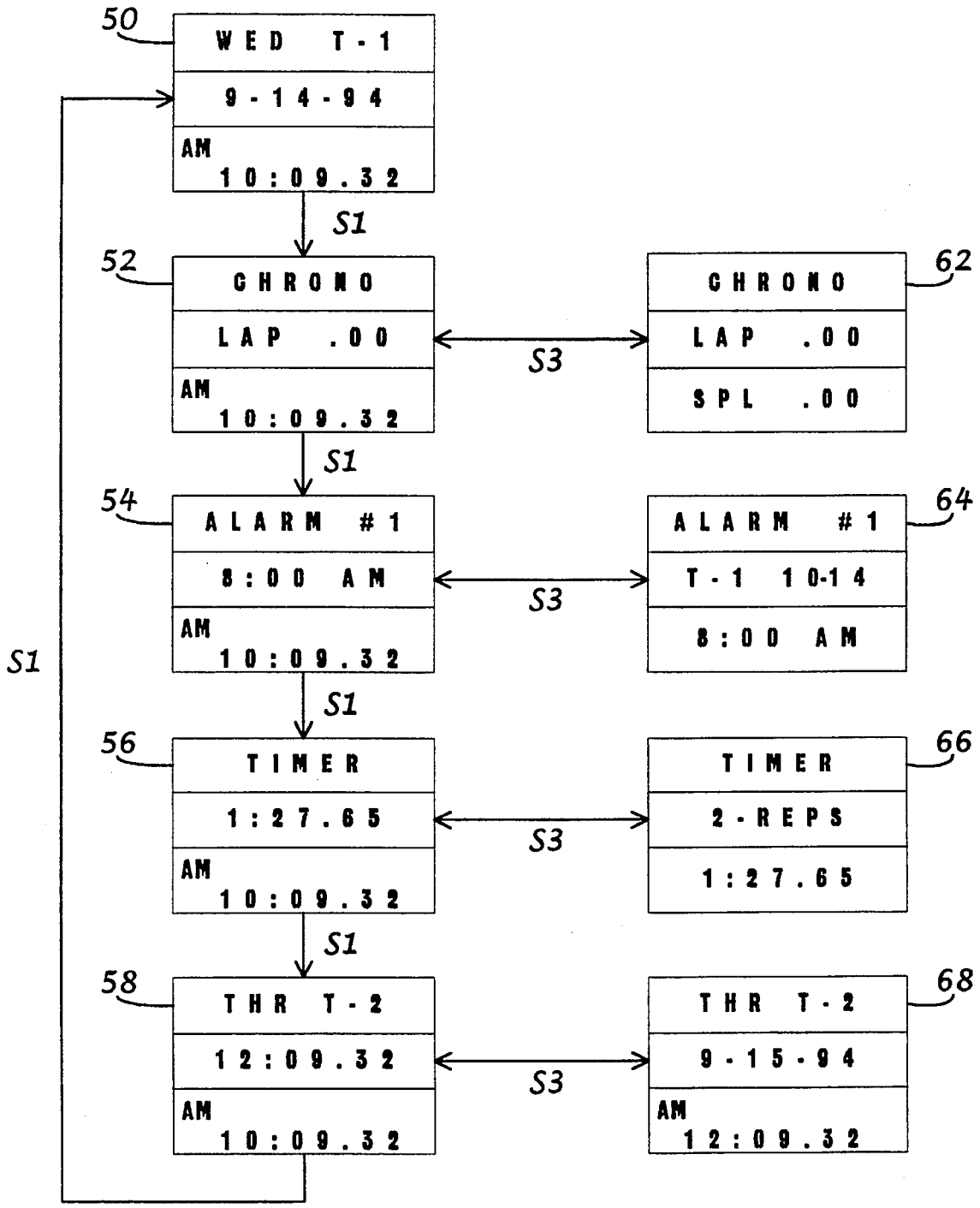
FIG. 4 is a block diagram of the preferred embodiment of the multimode timepiece of the present invention illustrating the states under mode preselect function.

FIG. 4 is a block diagram of the states under mode preselect function. For purposes of illustration, the preselected operating mode in FIG. 4 has been chosen as the TOD mode. The first block 50 represents the TOD mode showing 10:09.32 a.m. on Wednesday, Sep. 14, 1994. If the user actuates switch S3 at this point, the next operating mode in the predetermined sequence of operating modes will appear on the display 15, as described above in connection with FIG. 3. This means that CHRONO will appear on the display 15. If, however, the user actuates switch S1 instead, the timepiece 1 will simultaneously enter the mode preselect function and display the first mode in a predetermined sequence of modes for the mode preselect function. In FIG. 4, the first mode in the predetermined sequence of modes for the mode preselect function is the preselect function CHRONO mode, which is shown in block 52. Note that unlike the operating CHRONO mode, the preselect function CHRONO mode displays information from the preselected operating mode at the bottom of the display 15, which in FIG. 4 is the current time information from the TOD mode.

The reason for this will become clear in the discussion to follow.

The next mode in the predetermined sequence of modes for the mode preselect function is the preselect function ALARM mode, which is illustrated in block 54. The preselect function ALARM mode is displayed upon actuation of switch S1 from the preselect function CHRONO mode. Further actuation of switch S1 in the mode preselect function results in the appearance on the display 15 of the preselect function TIMER mode and the preselect function T2 mode, respectively shown in blocks 56 and 58. As is the case for the preselect function CHRONO mode, the preselect function ALARM, TIMER and T2 modes display the current time from the TOD mode at the bottom of the display 15. Finally, actuation of switch S1 from the preselect function T2 mode causes the timepiece 1 to exit the mode preselect function and return to the TOD mode.

From one of the preselect function modes, actuating switch S3 results in the engagement by the timepiece 1 of the corresponding operating mode. This means that upon actuation of switch S3, the timepiece 1 goes from the preselect function CHRONO mode to the CHRONO mode (block 62), from the preselect function ALARM mode to the ALARM mode (block 64), from the preselect function TIMER mode to the TIMER mode (block 66), and from the preselect function T2 mode to the T2 mode (block 68). Once the timepiece 1 has entered one of the operating modes, the operation of that mode is in accordance with the table shown in FIG. 3. Thus, actuation of switch S4 causes execution of the subroutine SET for changing the information displayed. From the SET subroutine, actuating switch S3 will SELECT a particular piece of information which is indicated on the display 15 by "flashing" the indicia for that piece of information, and actuating switch S1 will ADVANCE the value of said piece of information. The SET subroutine may be exited from by re-actuating switch S4. To return to the preselect function mode from the corresponding operating mode, the user simply needs to actuate switch S3.

As should be apparent from the foregoing description of FIG. 4, the mode preselect function of the present invention permits a user of the timepiece 1 to view, from any operating mode, information from a preselected operating mode without there being a need for the user to cycle through unwanted operating modes. The user only needs to actuate a designated switch once (the designated switch being S3 in FIG. 4) from any operating mode to observe information from the preselected operating mode. Furthermore, when the user actuates the designated switch to view information from the preselected operating mode, the user is still provided with a view of information from the operating mode just exited from (e.g., the preselect function TIMER mode 56 displays the elapsed time—1:27.65—from the TIMER mode 66 just exited from). The following example will demonstrate the significance of these stated advantages.

Let's assume that the user of the timepiece 1 of the present invention visits a track to run a series of laps around the track. While running the laps, the user engages the CHRONO mode of the timepiece 1 to time himself/herself. Let's also assume that occasionally, the user takes a brief respite to catch his/her breath, during which time the user checks the current time. If the user engages the CHRONO mode via the mode preselect function, i.e., actuates switch S1 to enter the preselect function CHRONO mode and then actuates switch S3 to engage the CHRONO mode, then for the user to check the current time, it is simply a matter of actuating switch S3 once to return to the preselect function CHRONO mode. Note that the preselect function CHRONO mode also permits the user to view the last lap time measured. Thus, when the user re-engages the CHRONO mode from the preselect function CHRONO mode by actuating switch S3, the user will know what his/her last lap time was.

On the other hand, if the user engages the CHRONO mode without employing the mode preselect function (as would be the case under prior art timepieces), then for the user to check the current time, the user will have to cycle through ALARM, TIMER and T2 modes (to get to the TOD mode). Furthermore, once in the TOD mode, the user no longer has access to any information from the CHRONO mode. These disadvantages of not employing the mode preselect function are only magnified as the number of operating modes available to the timepiece 1 increases. For instance, if the timepiece 1 had CALC, SPEED and PULSE modes in addition to those already listed, the user would have to cycle through ALARM - TIMER - T2 - CALC - SPEED - PULSE to check the current time information from the CHRONO mode.

It must be noted that the predetermined sequence of modes for the mode preselect function as shown in FIG. 4 is merely illustrative. The sequence of FIG. 4 was chosen to reflect the sequence of operating modes shown in FIG. 3. Also, the choice of switch S1 to enter into, cycle through, and exit from the mode preselect function is not binding. Any of the other available switches could be used to perform these operations. Likewise, the choice of switch S3 to jump between a preselect function mode and the corresponding operating mode is not binding.

Figure 5:
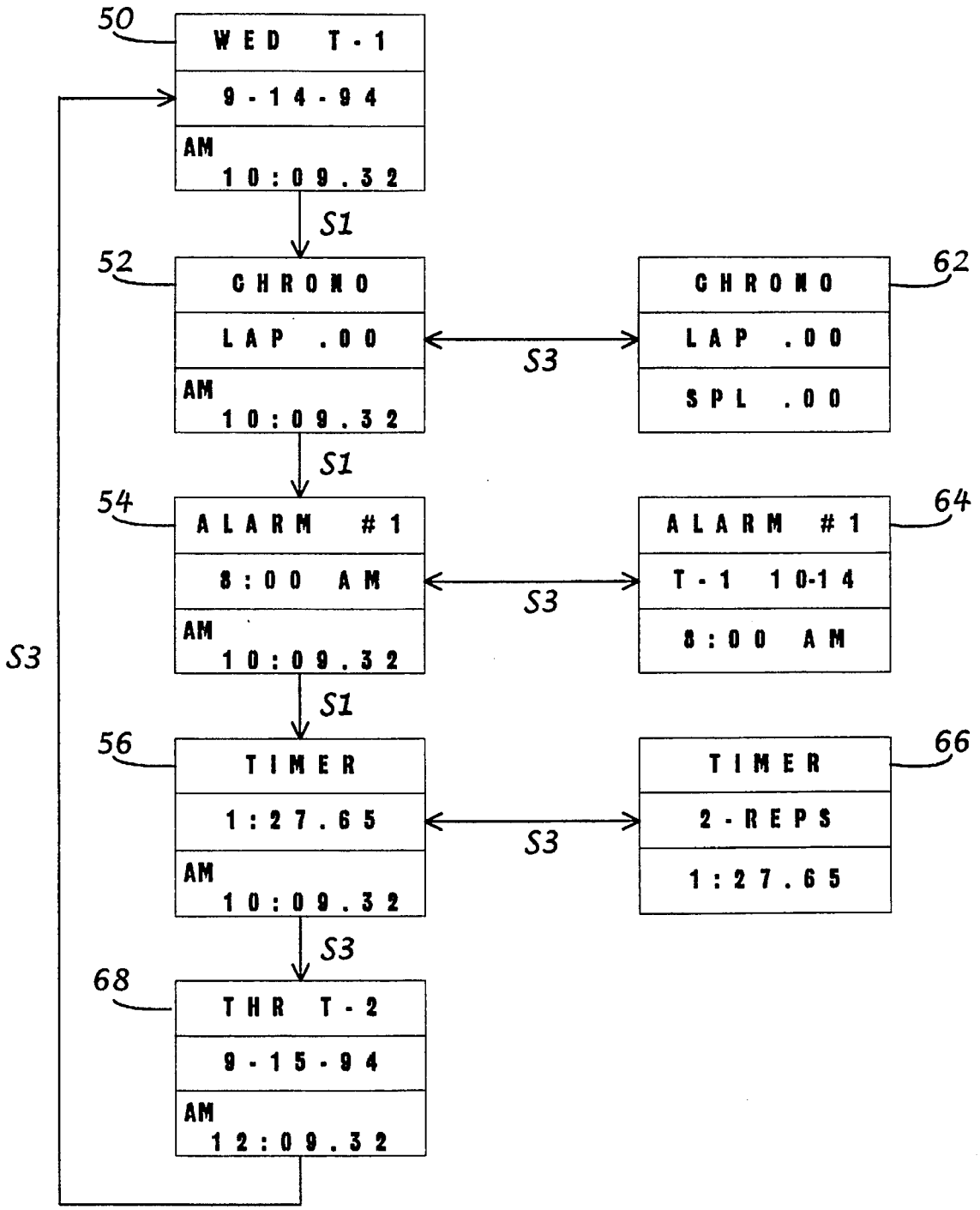
FIG. 5 is a block diagram of an alternate embodiment of the multimode timepiece of the present invention illustrating the states under mode preselect function.

FIG. 5 is a block diagram of the states under a second embodiment of the mode preselect function of the present invention. FIG. 5 differs from FIG. 4 in that there is no preselect function T2 mode (block 58). Thus, upon actuation of switch S1 from the preselect function TIMER mode (block 56), the timepiece 1 exits the mode preselect function and goes into the operating T2 mode, represented by block 68. From the T2 mode (block 68), actuation of switch S3 causes the timepiece 1 to return to the TOD mode (block 50). The reason for eliminating the preselect function T2 mode in FIG. 5 is as follows: The advantages offered by the mode preselect function of the present invention are realized when an operating mode (e.g., CHRONO) is engaged more than once by the user of the timepiece 1, with information from another operating mode sought between said engagements (as illustrated in the example above). Since T2 is not likely to be engaged repeatedly by the user, it therefore has been removed from the mode preselect function.

While there has been described what are considered to be the preferred embodiment and an alternate embodiment of the invention, other modifications will become known to those skilled in the art, and it is desired to cover in the appended claims all such modifications as fall within the true spirit and scope of the invention.

I claim:

1. An improved multimode electronic timepiece of the type having a display, a plurality of manually actuated switches, and an integrated circuit programmed to keep time, to provide a set of at least three operating modes, including time-of-day, in a continuous loop, and to permit an operator of the timepiece to shift said operating modes sequentially by selectively and repetitively actuating a first of said switches, wherein the improvement comprises:

mode preselect function means responsive to selective actuation of a second of said switches, said mode preselect function means comprising a program for the integrated circuit which provides a set of at least one preselect function mode in a continuous loop, each preselect function mode displaying information from a preselected operating mode along with information from another operating mode;

said program being adapted to permit the operator of the timepiece to shift sequentially through the set of preselect function modes by selectively, and where there is more than one preselect function mode in the set, repetitively actuating a third of said switches; and said mode preselect function means being further responsive to selective actuation of a fourth of said switches, actuation of said fourth switch causing the timepiece to shift between a preselect function mode and the operating mode, other than the preselected operating mode, having its information displayed by said preselect function mode.

2. The improved multimode electronic timepiece according to claim 1, wherein said preselected operating mode is time-of-day.

3. The improved multimode electronic timepiece according to claim 1, wherein said another operating mode is a chronograph mode.

4. The improved multimode electronic timepiece according to claim 1, wherein said another operating mode is an alarm setting mode.

5. The improved multimode electronic timepiece according to claim 1, wherein said another operating mode is an elapsed time mode.

6. The improved multimode electronic timepiece according to claim 1, wherein said another operating mode is an alternate time zone mode.

7. The improved multimode electronic timepiece according to claim 1, wherein said second switch is the same manually actuated switch as said third switch.

8. The improved multimode electronic timepiece according to claim 1, wherein said first switch is the same manually actuated switch as said fourth switch.

* * * * *